United States Patent [19]

Vandermeyden

[11] Patent Number: 4,832,259

[45] Date of Patent: May 23, 1989

[54] HOT WATER HEATER CONTROLLER

[75] Inventor: Torn R. Vandermeyden, Lakewood, Calif.

[73] Assignee: Fluidmaster, Inc., Anaheim, Calif.

[21] Appl. No.: 193,910

[22] Filed: May 13, 1988

[51] Int. Cl.[4] ..... F23N 1/08

[52] U.S. Cl. ..... 236/20 R; 126/362; 219/330; 237/8 R

[58] Field of Search ..... 236/20 R, 91 F; 126/362; 237/8 R; 219/330

[56] References Cited

U.S. PATENT DOCUMENTS

| | | | |
|---|---|---|---|
| 2,602,591 | 7/1952 | Wilson et al. | 236/91 F |
| 3,144,991 | 8/1964 | Marchant | 237/8 R |
| 4,497,438 | 2/1985 | Bonnne | 237/8 R |
| 4,522,333 | 6/1985 | Blau, Jr. et al. | 236/20 R |
| 4,620,667 | 11/1986 | Vandermeyden | 236/20 R |

*Primary Examiner*—William E. Wayner

*Attorney, Agent, or Firm*—Freilich, Hornbaker, Rosen & Fernandez

[57] ABSTRACT

A system is described for use with a hot water supply for hotels, apartment buildings and similar multi-unit structures, which controls the temperature $T_1$ of water at the outlet of the water tank that circulates past the units and back to the tank, to make the actual temperature $T_1$ close to a desired temperature DTEMP. The desired temperature at the tank outlet, DTEMP, is adjusted according to the measured temperature $T_3$ of recirculating water prior to its reentry into the tank. In cold weather, when $T_3$ decreases below a preset limit such as 105° F., indicating there is a considerable temperature drop along the pipeline before water reaches the last unit, the desired tank outlet temperature DTEMP is raised to more than it would otherwise be. As $T_3$ increases back toward the limit such as 105° F., the temperature DTEMP is lowered. The system therefore automatically adjusts for changes in temperature drop along the pipeline such as may be caused by seasonal or other environmental temperature changes or heavy demand for hot water.

11 Claims, 3 Drawing Sheets

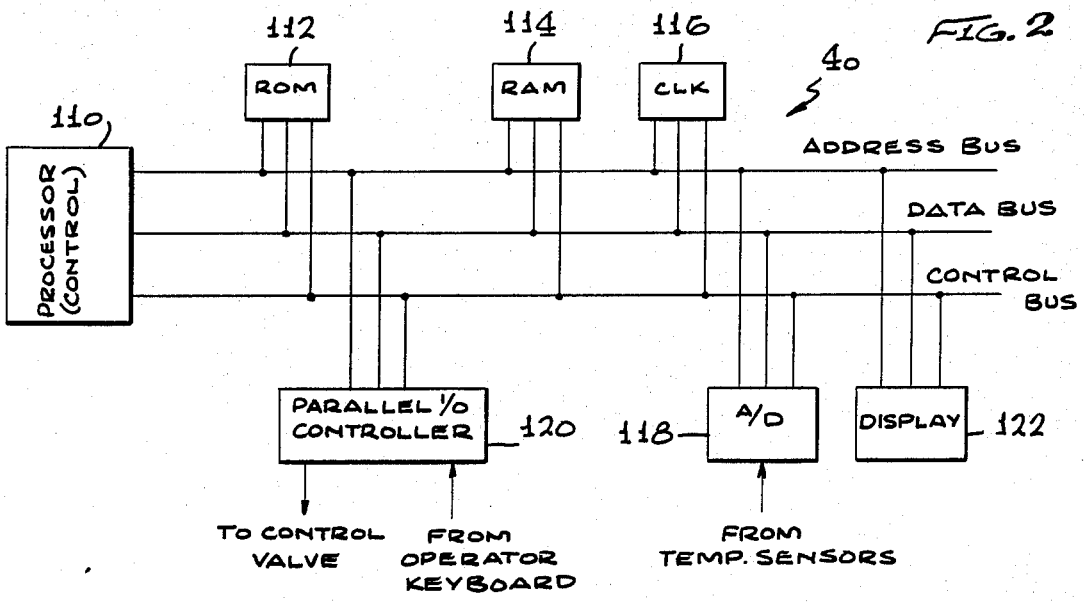
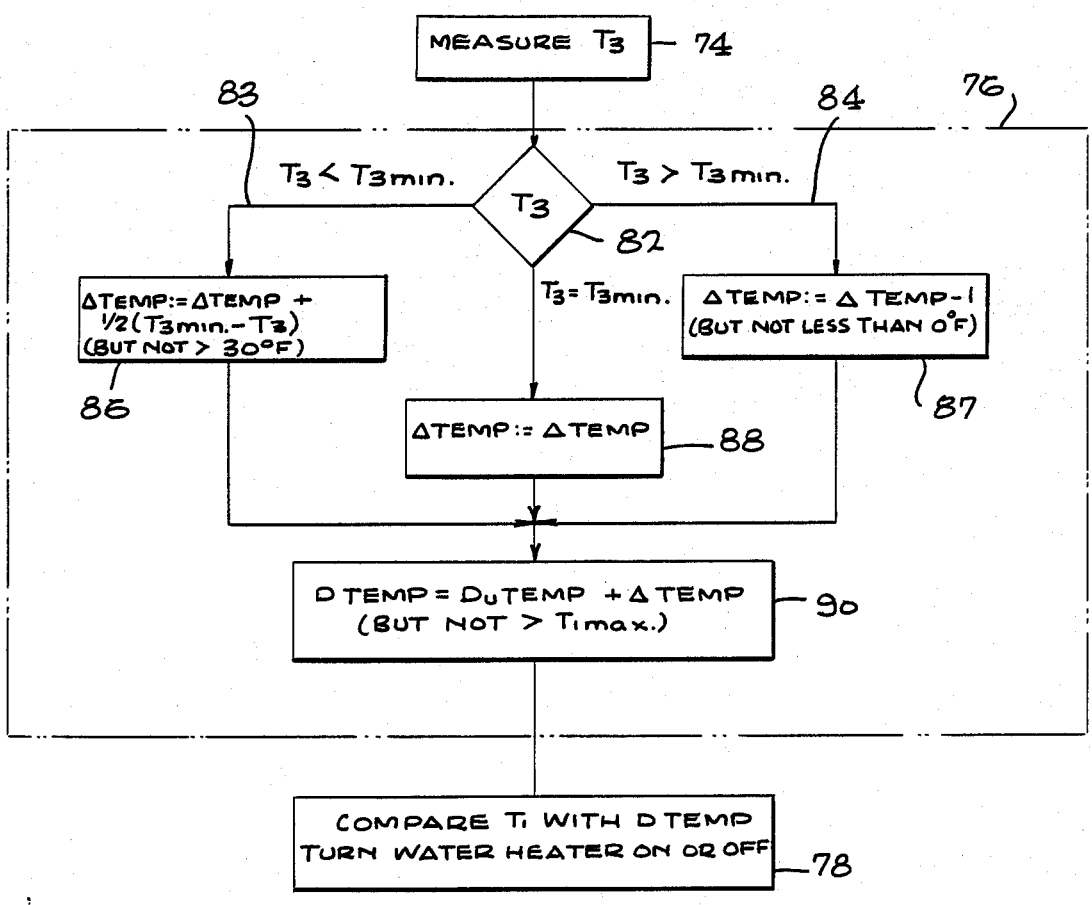
FIG. 4

HOT WATER HEATER CONTROLLER

BACKGROUND OF THE INVENTION

Water may be supplied to multi-unit structures or buildings such as hotels, apartment buildings, and the like by heating water in a tank so water at the tank outlet is at a desired temperature. The water circulates through a pipeline past the various units, and then back to the tank for recirculation. Older systems merely set the temperature of water at the tank outlet to a predetermined level such as 145° F., which was sufficient to assure that all units received water at a sufficient temperature such as 110° F. to avoid complaints. Considerable amounts of heat are lost along the pipeline extending between the tank outlet and the recirculating inlet, with the heat loss increasing with increasing water temperature in the pipeline. These losses are minimized by maintaining the temperature of water at the tank outlet, and therefore in the pipeline, at as low a level as possible, while still assuring that a minimum hot water temperature such as 110° F. is available to every unit.

An earlier U.S. Pat. No. 4,522,333, owned by the assignee of the present application, describes an improved system where the temperature $T_1$ at the water tank outlet is adjusted according to the anticipated demand for water, based on the history of water usage for that structure (e.g. hotel). For example, if the previous pattern of demand shows high demand at 7am on Wednesday, then the temperature $T_1$ at the tank outlet may be brought up to 145° F. shortly before 7am to assure adequate hot water. On the other hand, if the history shows a very low demand at 2am on Wednesday, the temperature $T_1$ may be set to 115° F., which will assure an adequate water temperature (e.g. 110° F.) at even a last unit along the pipeline. A system for more closely controlling the water heater is described in another U.S. Pat. No. 4,620,667 owned by the assignee of the present application, which accounts for "stacking" of water in the water tank (cold water falling to the bottom of the tank), and which attempts to determine changes in heat loss along the pipeline by determining the amount of heat required to maintain the desired $T_1$ when there is substantially no demand for water (such as at 2am).

While the systems described in the above-mentioned patents enable considerable fuel savings in hot water heating systems, while generally assuring a supply of water at adequate temperatures to all units, the systems do not accurately account for changes in heat loss with changes in ambient temperature. If the ambient temperature is 90° F., there will be a small heat loss along the pipeline, so that a lower than usual temperature $T_1$ is sufficient at the water tank outlet. On the other hand, if the ambient temperature is 20° F., there will be considerably greater heat losses along the pipeline, and a higher $T_1$ is needed to assure an adequate water temperature at all units. Attempting to determine heat losses along the pipeline by determining the amount of fuel used when there is minimal demand, is inadequate, especially for larger units where there may always be some demand, and because the amount of heating may be difficult to judge where the pressure of gaseous fuel varies. A hot water heating system which accounted for changes in heat losses along the pipeline to vary the desired temperature at the water heater outlet, so as to assure an adequate but not excessive hot water temperature at the last unit along the pipeline, would be of considerable value.

SUMMARY OF THE INVENTION

In accordance with one embodiment of the present invention, a water heater system is provided which adjusts the desired temperature at the outlet of the water tank, to accurately account for changes in heat loss along the pipeline leading from the tank outlet to the recirculating tank inlet. The system includes a sensor which senses the temperature $T_3$ of recirculating water at a location between substantially the last unit, or last water consumption station, and the recirculating water inlet of the tank. The desired temperature of water at the tank outlet is adjusted to bring the temperature $T_3$ near the recirculating inlet closer to a desired temperature.

In one system, if the temperature $T_3$ at the recirculating inlet is below the desired temperature $T_{3min}$, then the desired tank outlet temperature DTEMP is raised each half hour by one half the amount of $T_{3min}-T_3$. If the temperature $T_3$ at the recirculating inlet subsequently rises, the desired tank outlet temperature DTEMP is lowered by 1° F. every half hour.

The novel features of the invention are set forth with particularity in the appended claims. The invention will be best understood from the following description when read in conjunction with the accompanying drawings.

BRIEF DESCRIPTION OF THE DRAWINGS

FIG. 2 is a schematic view showing the processor and control of FIG. 1 in greater detail.

FIG. 4 is a flow chart showing additional details of the flow chart of FIG. 3.

DESCRIPTION OF THE PREFERRED EMBODIMENT

Figure 1:
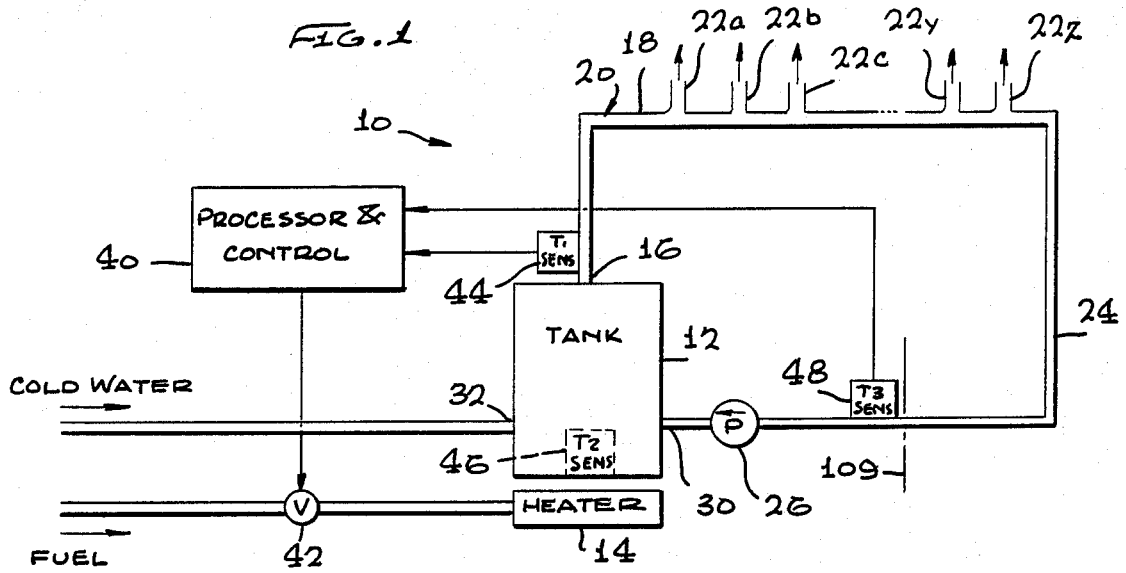
FIG. 1 is a schematic view of a typical hot water heating system incorporating the processor and control improvements of the present invention.

FIG. 1 illustrates a typical hot water heating system 10 for a multi-unit building such as a hotel. The system includes a hot water storage tank 12 whose water is heated by a heater 14. Water exits the tank through a tank outlet 16 and moves along a supply portion 18 of a pipeline 20 past numerous water consumption stations 22. The consumption stations which are labelled *22a–22z* may represent different units in the structure. After passing by the last consumption station or unit *22z* the water moves along a return portion 24 of the pipeline, through a recirculating pump 26, and to a recirculating inlet 30 of the water tank. As water is drawn off at the consumption stations, new cold water is supplied at a supply water inlet 32 leading to the tank.

There are two prime requirements in operating the system. The primary requirement is that all units be supplied with water of sufficiently high temperature, such as at least 110° F., at whatever consumption rate that occurs. A second consideration is that the amount of fuel used at the heater 14 be a minimum, while meeting the first requirement. For most hot water uses, such as for showers and baths, the user attempts to draw whatever amount of water is required to obtain a predetermined comfortable temperature; if the hot water supplied to the station is at a high temperature such as 145° F., a smaller volume of hot water will be drawn off than if a minimal temperature such as 115° F. is supplied. Thus, if the tank holds water of a high temperature such as 145° F. then there is more likely to be sufficient hot water during times of high demand than if the tank water temperature is lower. Many older buildings have therefore maintained the water tank temperature at a constant high level such as 145° F.

Considerable energy is lost by transfer of heat from the hot water-carrying pipeline 20 to the environment. Many hot water pipelines are poorly insulated and run along unheated portions of a building such as in the basement. While the supply portion 18 of the pipeline may be of moderate size, such as of 2 inch diameter pipe, the recirculating portion 24 may be of small size, such as 1 inch pipe. The amount of heat loss can be minimized by minimizing the temperature of water in the pipeline 20. Of course, as mentioned above, the water temperature must always be high enough at the last consumption station, such as at least 110° F., to meet the needs of the users.

As shown in FIG. 1, a processor and control 40 controls a fuel valve 42 to control the passage of fuel, such as natural gas, to the heater 14, to control the amount of heat applied to the hot water and therefore the temperature of hot water therein. A first sensor 44 senses the temperature $T_1$ of water at the tank outlet 16. Such a sensor can be merely strapped to the pipeline leading from the tank. A second sensor 46 can sometimes be used, to avoid the problem of "stacking" wherein the temperature of water at the bottom of the tank is much lower than the temperature at the top of the tank, although the sensing of that temperature $T_2$ is not always required. A third sensor 48 senses the temperature $T_3$ of recirculating water, at or after the last station **22*z* but before the recirculating inlet 30** of the tank.

A processor which relies upon the temperature $T_1$ at the tank outlet to minimize energy losses is described in U.S. Pat. No. 4,522,333. Basically, that system sets the hot water temperature $T_1$ at the tank outlet according to the expected demand for water, as indicated by the history of water usage at that facility. For example, if, on a Monday morning, the water consumption in the building is very low between 2am and 2:30am, then the following Monday at 2am the temperature $T_1$ may be set at a low level such as 115° F., which is sufficient to assure that the water temperature at the last unit **22*z* will be at least 110° F. If the water consumption on a Monday between 7am and 7:30am is very high, then during the following week on Monday at 7am, the temperature $T_1$ at the tank outlet may be set at 145° F. to assure there will be water of at least 110° F. at the last unit 22*z*** despite high water demand. However, in areas where the environmental temperature varies greatly, such as between 100° F. on hot summer days and 20° F. or lower on cold winter nights, the system did not adequately account for variations in the temperature drop of water along the pipeline due to losses from the pipeline to the environment.

Figure 3:
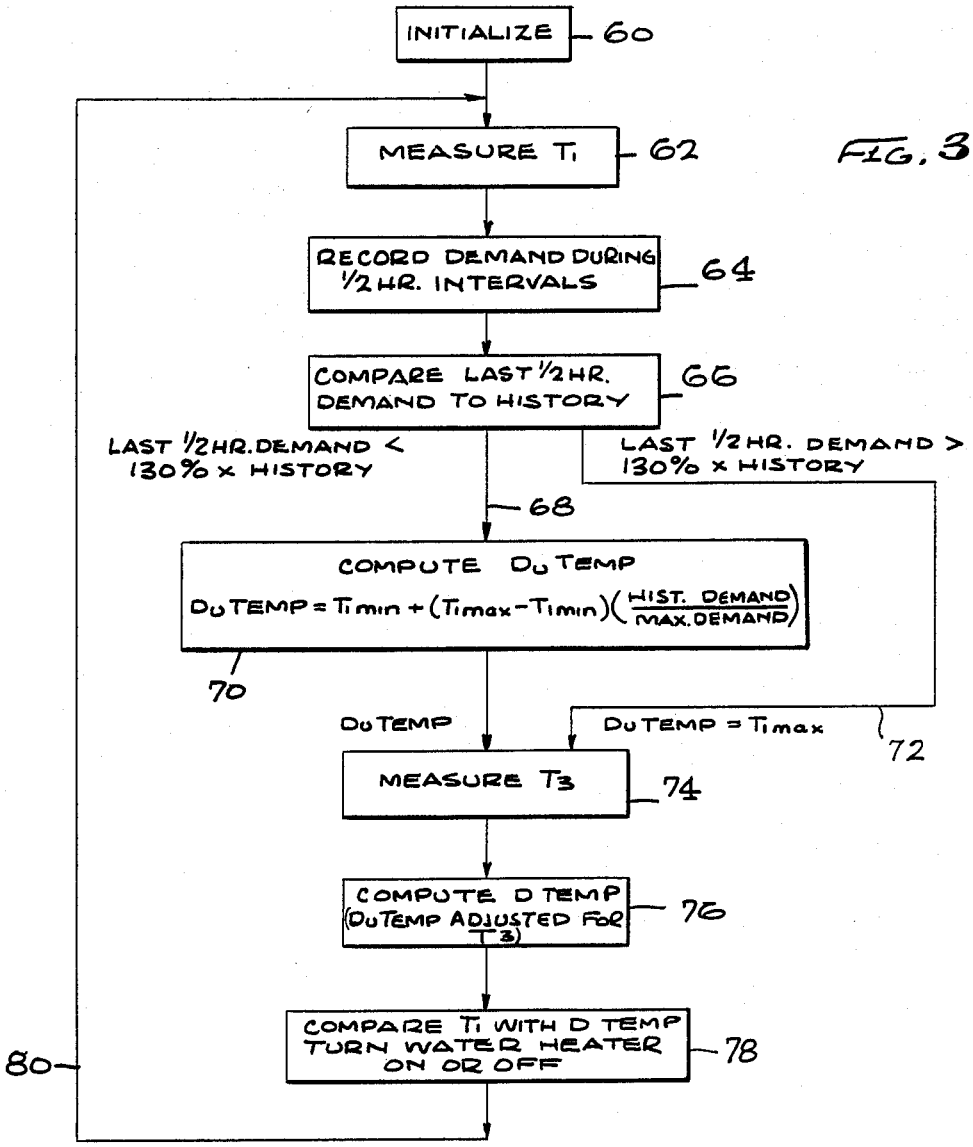
FIG. 3 is a flow chart showing the overall sequence of operation of the system of FIG. 1.

FIG. 3 is a flow chart which shows the manner in which the system of FIG. 1 operates. It should be understood that the temperature $T_1$ indicates the actual measured temperature at the water tank outlet, DTEMP represents the desired temperature at the tank outlet, and $D_u$TEMP represents the desired temperature at the water tank outlet before an adjustment is made based on the temperature $T_3$ along the recirculating portion of the pipeline. The first step indicated by block 60 is to initialize the system, during which the desired temperature DTEMP is set at the maximum temperature 145° F.; the maximum temperature such as 145° F. is typically the level used for the building prior to installation of the present system. A next step 62 is to measure the actual temperature $T_1$ at the tank outlet. A next step 64 is to record the demand for hot water heating during each one half hour interval. The demand can be determined to equal the amount of fuel used during a particular half hour period, divided by the maximum amount of fuel used during any half hour period for the past 24 hours. Where the valve 42 (FIG. 1) is either turned completely on or off, the amount of time that the valve was on during a one half hour period indicates the demand for hot water during that period.

The next step in FIG. 3, at 66, is to compare the demand for hot water during the previous half hour to the historical demand, such as the demand during a corresponding half hour exactly one week previously. This comparison is used to determine whether the present demand pattern is similar to the previous history, or whether there is a drastic change such as may be caused by a switch between standard and daylight savings time or a holiday. A first possibility indicated by line 68 is that the demand during the past half hour is no more than 130% of historical demand (e.g. demand at the same time one week ago). In that case, the next step 70 is to compute $D_u$TEMP, which is the desired temperature at the tank outlet, but before adjustments for the measured temperature $T_3$. The formula for $D_u$TEMP is:

$$D_u\text{TEMP} = T_{1min} + (T_{1max} - T_{1min}) \frac{\text{HISTORICAL DEMAND}}{\text{MAX DEMAND}} \qquad \text{Eq. 1}$$

where $T_{1min}$ is the minimum allowable temperature at the tank outlet, such as 115° F., $T_{1max}$ is the maximum tank outlet temperature such as 145° F. Historical demand is a measure of the amount of heat used during a comparable historic half hour period, such as the heater being on 10 minutes or 30% of the time during a half hour period one week ago. MAX DEMAND represents the maximum demand, such as the heater being on all 30 minutes or 100% of the time during the half hour period within the last 24 hours when demand was greatest. In one example, where $T_{1min}$ is 115° F., $T_{1max}$ is 145° F., and the ratio of demands is 30%, the quantity $D_u$TEMP is equal to 124° F. This means that where this formula is used and no further temperature adjustment must be made, a temperature $T_1$ of 124° F. would be sufficient to assure that all stations will receive water at at least 110° F. for the most likely pattern of consumption expected during that one half hour period.

Referring again to block 66, another possibility indicated by line 72 is that demand during the previous one half hour is more than 130% of historical demand (during a comparable period one week previously). In that case, the temperature $D_u$TEMP is set to equal the maximum temperature $T_{1max}$, which in the above example is 145° F.

In a next step indicated at 74, the temperature $T_3$ along the return portion of the pipeline is measured. In a next step 76, the desired temperature DTEMP is computed taking into consideration the measured temperature $T_3$ (to be described below). In the next step 78, the actual measured temperature $T_1$ is compared with DTEMP, and the water heater is turned on or off to make them equal (of course, if $T_1$ is greater than DTEMP, the heater is kept off and $T_1$ will fall to equal DTEMP). The line 80 represents a repeat of the precedure. The precedure of FIG. 3 can be repeated at intervals such as every second, with the new measured temperatures $T_1$ and $T_3$ taken again, but with the results of computations at steps 70 and 76 kept constant during the period of one half hour.

FIG. 4 illustrates details of the step 76 in FIG. 3, where DTEMP, the desired temperature at the tank outlet, is computed by adjusting $D_u$TEMP according to the measured temperature $T_3$ along the return portion of the pipeline. The measurement of $T_3$ is made to generate an adjustment temperature or increment ΔTEMP by which $D_u$TEMP is to be adjusted. In the particular system of FIG. 4, ΔTEMP is always 0 or positive to increase the desired temperature in the event that $T_3$ is too low. $T_3$ may be too low where cold weather cools the pipeline 20 to an unacceptable low temperature at the last station 22z, even though the tank temperature $T_1$ would be adequate in warmer weather. ΔTEMP is not allowed to be negative in the embodiment of the invention described herein. However, with assurance that the temperature at the last station will not be too low even in cold weather, the unadjusted tank temperature can be set lower.

After the step 74 where $T_3$ is measured, $T_3$ is compared to a minimum acceptable recirculating temperature $T_{3min}$. $T_{3min}$ may, for example, equal 105° F. where it is assumed that even in hot weather where the temperature at the last station 22z is only slightly higher than $T_3$, that the temperature at 22z will be sufficient to avoid complaints. In step 82, a decision is made as to whether $T_3$ is less than $T_{3min}$ (in which case the process continues along line 83), or $T_3$ is greater than $T_{3min}$ (the process then continues along line 84), or $T_3$ equal $T_{3min}$ (the process then continues along line 85). Then an adjustment temperature ΔTEMP is computed. ΔTEMP is the amount to be added to the unadjusted temperature $D_u$TEMP in order to adjust for $T_3$ to obtain the desired temperature DTEMP.

If $T_3$ is less than $T_{3min}$ (e.g. where $T_3$ equals 101° F.) then the process continues along line 83 to step 86 where ΔTEMP is computed by the following equation:

$$\Delta TEMP := \Delta TEMP + \tfrac{1}{2}(T_{3min} - T_3) \qquad \text{Eq. 2}$$

where ":=" indicates that the quantity (ΔTEMP) on the left side of the equation equals a function of the previous value of that quantity (ΔTEMP) as set out on the right side of the equation. In one example, ΔTEMP previously equalled 2° F., $T_{3min}$ equals 105° F., while $T_3$ is measured to be 101° F. ΔTEMP then equals 4° F. However, step 86 is constrained so the computed ΔTEMP does not exceed a predetermined limit such as 30° F. Thus, if the recirculation temperature is too low, the adjustment temperature is raised by one-half the amount by which $T_3$ is too low.

If $T_3$ is greater than $T_{3min}$ then the process continues from step 82 along line 84 to step 87 where ΔTEMP is computed by the following equation:

$$\Delta TEMP := \Delta TEMP - 1, \text{ but } \Delta TEMP \geqq 0 \qquad \text{Eq. 3.}$$

In one example, ΔTEMP previously equalled 2° F., $T_{3min}$ equals 105° F., while $T_3$ is measured to equal 109° F. DTEMP then equals 1° F. However, step 88 is contrained so if the computed ΔTEMP is below zero, the new ΔTEMP is made to equal zero.

If $T_3$ equals $T_{3min}$, then the process continues along line 85 to step 88, with the new ΔTEMP equal to the previous value.

The value of DTEMP, which equals $D_u$TEMP adjusted for $T_3$, is computed in step 90 by the following equation:

$$DTEMP := D_u TEMP + \Delta TEMP \qquad \text{Eq. 4}$$

where ΔTEMP equals the quantity calculated in step 86, 87 or 88, depending on whether $T_3$ is less than, greater than, or equal to $T_{3min}$. However, DTEMP will not be allowed to exceed the maximum tank outlet temperature such as 140° F. Where the computation in steps 82 and 86–88 occur at considerably spaced intervals such as every half hour, it is possible to use $T_3$ as measured during a particular time in a period such as the middle of a half-hour period, or to use the average value of $T_3$ during the period. Applicant prefers the latter.

Thus, adjustments are made to the desired tank water temperature DTEMP based upon a comparison with a preset desired or minimum recirculating temperature $T_{3min}$. If $T_3$ (its average value in this system) is below $T_{3min}$, the desired tank outlet temperature is raised by only half the difference every ½ hour, to avoid a large response to what may be a temporary phenomenon. If the measured (averaged) $T_3$ is above $T_{3min}$, the desired tank outlet temperature is lowered by only one degree every half hour, to exercise even more caution against a response to what may be a temporary phenomenon that would reduce the tank temperature. The tank temperature is always at least equal to $D_u$TEMP, and the adjustment is made only to increase the tank temperature above $D_u$TEMP, in the particular system described. Of course, it is possible to construct a system where a high $T_3$ can lower DTEMP to below $D_u$TEMP.

After step 90, the next step 78 is performed, of controlling the water heater to bring $T_1$ to the desired temperature DTEMP. The calculation of new desired temperatures DTEMP and $D_u$TEMP and a new adjustment temperature is made at intervals or periods of one-half hour. The periods should be greater than one minute to allow time for the system to react (e.g. to allow hotter water at the $T_1$ sensor to increase $T_3$). The periods should not be more than about an hour because there are significant predictable changes in demand during periods of less than an hour in most multi-unit buildings. However, the step 62 (FIG. 3) of measuring $T_1$ and step 78 to bring $T_1$ to DTEMP are carried out at much more frequent intervals such as every 10 seconds. Also, the step 64 of recording demand occurs at intervals such as every 10 seconds.

In the step shown at 86 (FIG. 4) where ΔTEMP is calculated, it is noted that ΔTEMP changes by only one half the difference between the measured $T_3$ and $T_{3min}$. This is done to avoid instability in the system, and to avoid large changes due to temporary phenomena, such as a workman temporarily opening the outside door to the boiler room which can cause $T_3$ to suddenly drop in cold weather or to rise in hot weather. By raising the tank outlet temperature $T_1$ when $T_3$ falls below the set minimum $T_{3min}$, applicant avoids excessively cold water at the last consumption station, due to phenomena such as cold weather that leads to a greater temperature drop along the pipeline. By lowering the desired tank outlet temperature by only 1° F. in each half hour period, when $T_3$ is above $T_{3min}$ (and ΔTEMP is positive) applicant gradually returns DTEMP to $D_u$TEMP while avoiding large changes that may be due to temporary phenomena (such as the opening of the boiler room door).

Figure 7:
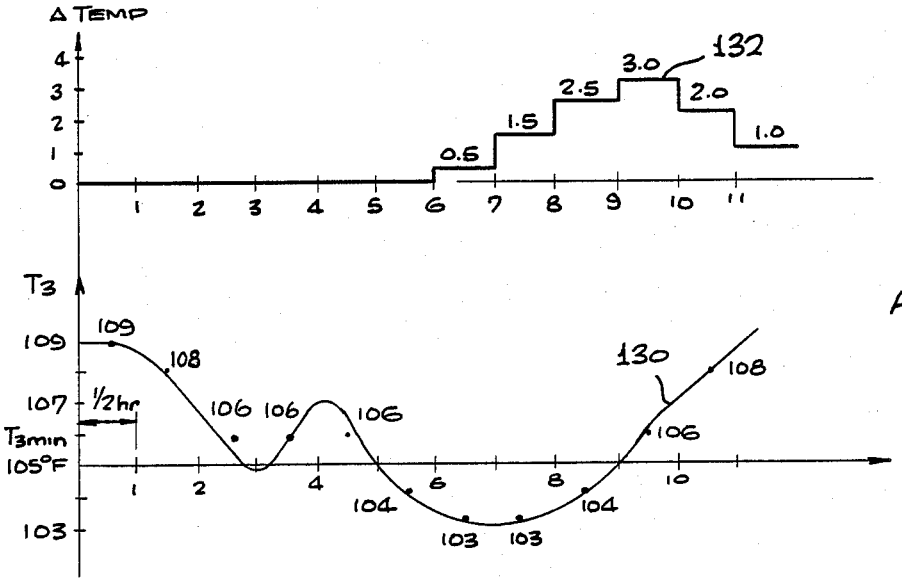
FIG. 7 is a graph showing how changes in the recirculating water temperature $T_3$ with respect to a minimum $T_3$ affects changes in an adjustment temperature TEMP.

FIG. 7 contains a line 130 showing an example of variations in $T_3$ at half-hour intervals, and also contains a line 132 showing the corresponding ΔTEMP. $T_{3min}$ is set at 105° F. and ΔTEMP is initially at zero. Numbers such as "109" and "108" along line 130 represent the average value of $T_3$ during a half-hour interval. Since, in the above described system, ΔTEMP cannot fall below zero, there is initially no change ΔTEMP. When the averaged $T_3$ (during a half-hour) falls to 104 during period 5–6, then ΔTEMP increases to 0.5 at the beginning of period 6. ΔTEMP continues to increase so long as $T_3$ is below $T_{3min}$. During period 9–10 when averaged $T_3$ rises to 106 which is above $T_{3min}$, ΔTEMP falls by one degree.

Figure 5:
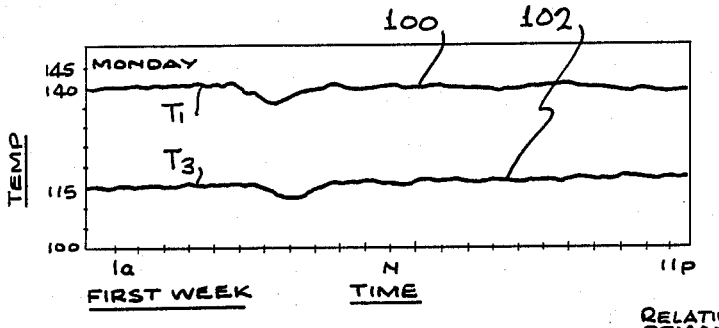
FIG. 5 is a chart showing variations in hot water measurements at two locations of the system of FIG. 1 during an initial or first week of operation of the system of FIG. 1.
Figure 6:
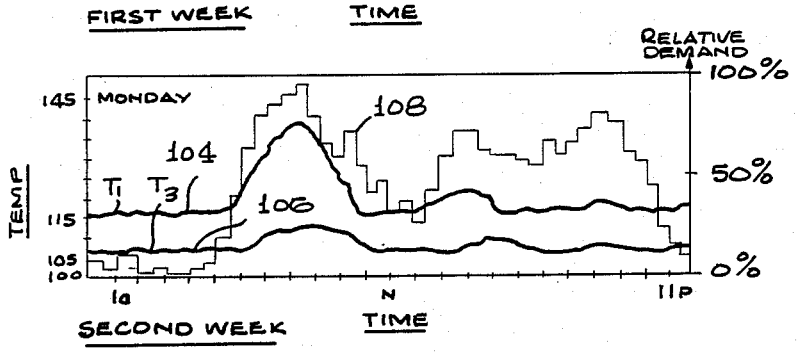
FIG. 6 is a chart similar to that of FIG. 5, but showing the hot water temperature measurements during the following week.

FIGS. 5 and 6 provide an example of operation of a system of the present invention during a 24 hour period of the first or initial week of operations (FIG. 5), and during a corresponding 24 hour period one week later (FIG. 6). FIG. 5 includes a line 100 represented the measured temperature $T_1$ at the tank outlet, and includes a second line 102 representing the measured temperature $T_3$ along the return portion of the pipeline. During the initial week, the desired temperature DTEMP at the tank outlet was set at 140° F., and the actual temperature $T_1$ remained close to this, except that it dropped by about 5° during a period of maximum hot water demand. The temperature $T_3$ along the return portion of the pipeline similarly remained at about 115° F., except that it dropped during a period of heavy water demand.

FIG. 6 includes two lines 104, 106 respectively representing $T_1$ and $T_3$ during the seciond week. A graph 108 indicates the demand for hot water during each ½ hour interval, as indicated by the percent of time the heater was on during the period. It can be seen from FIG. 6 that the tank outlet temperature $T_1$ was maintained at a low level such as 117° F. during periods of low demand. The temperature $T_3$ remained close to 107° F., except that it rose during a short time after the temperature $T_1$ rose. While changes in anticipated demand for hot water results in large and rapid changes in the outlet tank temperature $T_1$, measurements which indicate $T_3$ is above or below a minimum $T_3$ result in only small and gradual changes in the outlet tank temperature, and the effect of the $T_3$ measurements may not be readily apparent by the graph of FIG. 6. However, the adjustments for $T_3$ result in gradually increasing the tank outlet temperature where it appears that the water temperature at the last unit will be too cold, or in decreasing the tank outlet temperature where the water temperature at the last station appears to be hotter than required.

Figure 8:
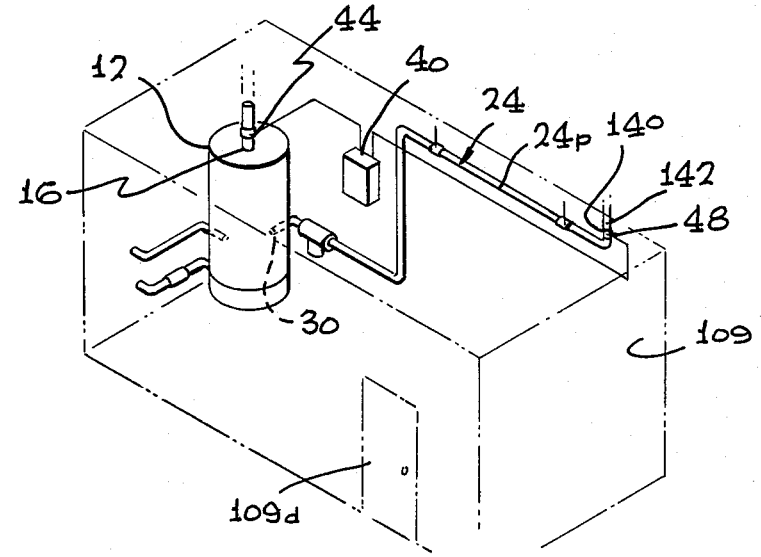
FIG. 8 is a partial perspective view of a boiler room containing part of the system of FIG. 1.

One matter that must be determined in setting up an actual system, is determining where to place the $T_3$ temperature sensor 48 (FIG. 1) along the return portion of the pipeline. It would be desirable to place the sensor 48 at or immediately downstream from the last consumption station 22z. However, this is generally impractical because the hot water pipeline is generally not easily accessible near the consumption stations and because it is costly to run wires from the last station to the processor, which is typically located in the boiler room near the heater, fuel valve, and water tank. Instead, the $T_3$ sensor 48 is most easily attached to the return portion of the pipeline at the position where it enters the boiler room indicated at 109 in FIG. 1, and shown in FIG. 8. The sensor 48 is placed at a location 140 along the return portion 24 of the pipeline closer to the location 142 where the pipeline enters the boiler room 109 than to the tank recirculating inlet 30, the distance between the location 140 and inlet 30 generally being a plurality of meters. It is desirable to place the $T_3$ sensor 48 as far from the heater and hot water tank as possible, to minimize the influence of these sources of heat on the temperature sensor $T_3$. It is also desirable to place the $T_3$ sensor 48 close to the location 142 where the return pipeline enters the boiler room; this places the sensor 48 upstream of most of the part **24*p* of the pipeline lying in the boiler room. That part 24*p* is subject to cooling when the boiler room door 109*d* is opened in cold weather and where much of the insulation around the part 24*p* has fallen off. As with the $T_1$ temperature sensor, the $T_3$ sensor 48 may be installed by clamping a sensor to the pipeline and running wires from there to the control 40**.

FIG. 2 illustrates some details of the processor and control 40, which includes a microprocessor 110, a ROM (read only memory) 112, a RAM (random access memory) 114, and a clock 116 that times all the circuitry. An analog-to-digital converter 118 converts the electrical signal outputs from the $T_1$ temperature sensor and $T_3$ temperature sensor (and also possibly the $T_2$ temperature sensor) to digital signals for input to the control circuitry of th processor. A parallel input-output controller 120 controls the passage of information from a keyboard to the processor, and from the processor to the control valve 42 that controls the flow of fuel to the heater. A display 122 enables an operator to see the inputted data. The operator can enter the desired $T_{3min}$ and the maximum $T_1$ (which will equal DTEMP during the initial week). Details of this are described in the earlier U.S. Pat. No. 4,522,333 mentioned above.

It should be understood that there are a variety of hot water heater systems installed in buildings, including those with multiple tanks and those with no storage tank. While additional sensors may be useful in such systems, the present control relies upon sensing or determining temperatures $T_1$ and $T_3$ closely related to the water temperature at the outlet of the pipeline, and at or after the last consumption station along the pipeline.

Thus, the invention provides an improvement to a water heater system of the type that determines the desired temperature DTEMP at the water tank outlet according to the anticipated demand for water. The invention permits a further adjustment in the desired outlet temperature according to the measured water temperature $T_3$ substantially along the recirculating portion of the pipeline. As the temperature $T_3$ increases or decreases with respect to a predetermined minimum recirculating temperature $T_{3min}$, the desired tank outlet temperature DTEMP is respectively decreased or increased. This results in the temperature of water at the tank outlet being increased when $T_3$ drops below $T_{3min}$, which indicates an excessive temperature drop along the pipeline such as may be due to a lower ambient temperature, to avoid complaints about inadequate hot water while minimizing energy consumption. If $T_3$ subsequently rises above $T_{3min}$, the tank temperature is lowered. The change in DTEMP is generally less than the change in $T_3$, to avoid large changes in DTEMP because of temporary phenomena affecting $T_3$, and to avoid instability in this equivalent feedback system. The sensor for measuring $T_3$ is preferably mounted on a location along the pipeline at least two meters away from the recirculating inlet, to minimize heating of the sensor by the heater or hot water tank, and to make the measurement of $T_3$ less sensitive to heating or cooling of that part of the return pipeline portion which lies in the boiler room where disturbances are most likely.

Although particular embodiments of the invention have been described and illustrated herein, it is recognized that modifications and variations may readily occur to those skilled in the art and consequently it is intended to cover such modifications and equivalents.

What is claimed is:

1. In a hot water heating system for a structure with numerous water consumption stations including a last station, which includes tank means having an outlet, a supply water inlet and a recirculating inlet, and which also includes heater means for heating water in said tank means, a pipeline with a supply portion extending from said outlet past said stations and with a return portion extending from a last of said stations to said recirculating inlet, and a recirculating pump for pumping water along said pipeline to flow some of it back to said recirculating inlet, the improvement comprising:

a first temperature sensor for sensing the temperature $T_1$ of water substantially at said outlet;

a second temperature sensor for sensing the temperature $T_3$ of water substantially along said return portion of said pipeline;

processor and control means responsive to the temperatures $T_1$ and $T_3$ sensed by said sensors, for controlling said heater to produce a temperature $T_1$ close to a desired outlet temperature DTEMP, said control means being responsive to changes in $T_3$ to determine DTEMP, with DTEMP respectively increasing and decreasing as $T_3$ respectively decreases and increases.

2. The improvement described in claim 1 wherein:

said control means responses to a difference $\Delta T_3$ between a measured temperature $T_3$ sensed by said second sensor and a predetermined desired minimum temperature $T_{3min}$, to change DTEMP, by an amount less than $\Delta T_3$.

3. The improvement described in claim 2 wherein:

said control means increases DTEMP by a predetermined fraction of $T_3$ when $T_3$ is less than $T_{3min}$, but decreases DTEMP by a preset maximum amount during periods when $T_3$ is greater than $T_{3min}$ regardless of how great $T_3-T_{3min}$ is, whereby to avoid a low hot water temperature $T_1$ when a rise in $T_3$ is due to an anomaly.

4. The improvement described in claim 1 wherein:

said control means determines a new desired outlet temperature DTEMP at intervals spaced at least one minute but no more than one hour apart.

5. The improvement described in claim 1 wherein:

said return portion of said pipeline has a length of a plurality of meters, and said means for coupling said second sensor mounts and second sensor to said pipe at a location spaced a plurality of meters away from said recirculating inlet of said tank.

6. Apparatus for use with a hot water heating system which includes a tank means having an outlet, a supply water inlet, and a recirculating inlet, and which includes heater means for heating water in said tank means, a pipeline with a supply portion extending between said outlet and each of a plurality of water consumption stations and with a return portion extending from the last of said stations to said recirculating inlet, and a recirculating pump for pumping water along said pipeline comprising:

a first sensor means for sensing the hot water temperature $T_1$ substantially at said outlet;

second sensor means for sensing the hot water temperature $T_3$ at a location substantially along said recirculating portion of said pipeline;

processor and control means for determining a desired hot water temperature DTEMP at said outlet, said control means including means for determining an unadjusted desired temperature $D_u$TEMP and for respectively increasing and decreasing $D_u$TEMP to obtain DTEMP according to whether $T_3$ is respectively less than and greater than a predetermined value $T_{3min}$;

said control means being coupled to said heater to operate said heater when $T_1$ is less then DTEMP to bring $T_1$ close to DTEMP.

7. The apparatus described in claim 6 wherein:

said control means is constructed to determine $D_u$TEMP according to a history of hot water demand during each of different time periods of a repeating series of time periods for said hot water heating system, with DuTEMP being raised or lowered when the history of demand indicates that the demand in the next of said time periods will be respectively higher of lower than in the present time period;

said control means is constructed to decrease $D_u$TEMP by less than 100% of any difference between $T_3$ and $T_{3min}$ when $T_3$ is greater than $T_3$min.

8. A method for controlling a hot water heating system which includes a tank means having an outlet, a supply water inlet and a recirculating inlet, and which includes heater means for heating water in said tank means, a pipeline with a supply portion extending between said outlet and each of a plurality of water consumption stations and with a return portion extending from the last of such stations to said recirculating inlet, and a recirculating pump for pumping water along said pipeline, comprising:

measuring the temperature $T_1$ at said outlet;

measuring the temperature $T_3$ at a predetermined location along said return portion of said pipeline;

determining whether $T_3$ is greater or less than a predetermined desired temperature $T_3$min;

determining a desired hot water temperature DTEMP at said outlet, including determining an unadjusted desired temperatue $D_u$TEMP and respectively increasing and decreasing $D_u$TEMP to obtain DTEMP according to whether $T_3$ is respectively less than and greater than $T_3$min;

operating said heater when $T_1$ is less than DTEMP to bring $T_1$ close to DTEMP.

9. The method described in claim 8 wherein:

said steps of determining whether $T_3$ is greater or less than $T_{3min}$ includes determining the difference between $T_3$ and $T_{3min}$ to obtain a quantity $\Delta T_3$, and said step of increasing $D_u$TEMP to obtain DTEMP includes increasing $D_u$TEMP by a predetermined percentage of $T_3$ which is less than 100% of $\Delta T_3$.

10. The method described in claim 8 wherein:

said step of decreasing DuTEMP to obtain DTEMP includes decreasing $D_u$TEMP by a preset amount during each predetermined period of time when $T_3$ is greater than $T_{3min}$.

11. In a hot water heating system for a structure with numerous water consumption stations including a last station, which includes walls forming a boiler room, a water tank located in said boiler room and having an outlet, a supply water inlet and a recirculating inlet, and which also includes a heater in said room for heating water in said tank, a pipeline with a supply portion extending from said outlet and out of said room and past said stations and with a return portion extending from the last of said stations into said room to said recirculating inlet, and a recirculating pump for pumping water along said pipeline to flow some of it back to said recirculating inlet, the improvement comprising:

a first temperature sensor for sensing the temperature $T_1$ of water substantially at said outlet and generating an electrical signal representing $T_1$;

a second temperature sensor for sensing the temperature $T_3$ of water substantially along said return portion of said pipeline and generating an electrical signal representing $T_3$;

control cicuitry connected to said sensors and said heater, said control circuitry constructed to operate said heater to increase $T_1$ when $T_3$ decreases below a predetermined level;

said return portion of said pipeline extending into said boiler room at a location spaced a plurality of meters from said recirculating inlet;

said temperature sensor located along said return portion of said pipeline which is closer to said location than to said recirculating inlet, whereby the sensing of $T_3$ is made at a pipeline position that is far from the tank and upstream of most of the part of the return portion of the pipeline that would be cooled by air in said room.

* * * * *